US005439559A

United States Patent [19]

Crouse

[11] Patent Number: 5,439,559

[45] Date of Patent: Aug. 8, 1995

[54] HEAVY-WEIGHT HIGH-TEMPERATURE PRESSING APPARATUS

[75] Inventor: Jere W. Crouse, Beloit, Wis.

[73] Assignee: Beloit Technologies, Wilmington, Del.

[21] Appl. No.: 195,522

[22] Filed: Feb. 14, 1994

[51] Int. Cl.[6] ..... D21F 3/04; D21F 5/02

[52] U.S. Cl. ..... 162/358.5; 162/359.1; 162/360.2; 162/360.3

[58] Field of Search ..... 162/206, 358.3, 358.4, 162/358.5, 359.1, 360.2, 360.3, 375; 100/93 RP; 34/111, 116

[56] References Cited

U.S. PATENT DOCUMENTS

| | | | |
|---|---|---|---|
| 4,016,032 | 4/1977 | Kankaanpaa | 162/360.3 |
| 4,324,613 | 4/1982 | Wahren | 162/111 |
| 4,738,752 | 4/1988 | Busker et al. | 162/359 |
| 4,792,381 | 12/1988 | Pajula | 162/360.3 |
| 4,915,790 | 4/1990 | Dahl | 162/360.2 |
| 4,976,820 | 12/1990 | Laapotti | 162/358.3 |
| 5,047,122 | 9/1991 | Crouse et al. | 162/206 |
| 5,065,529 | 11/1991 | Skaugen et al. | 34/117 |
| 5,082,533 | 1/1992 | Pulkowski et al. | 162/359 |
| 5,087,325 | 2/1992 | Page | 162/193 |
| 5,120,399 | 6/1992 | Filzen | 162/205 |

*Primary Examiner*—Karen M. Hastings

*Attorney, Agent, or Firm*—Dirk J. Veneman; Raymond W. Campbell; David J. Archer

[57] ABSTRACT

An extended nip press has a heated backing roll, on the surface of which a paper web is preheated before it passes through the extended nip. The paper web is restrained on the surface of the backing roll to achieve post-pressing drying. During a portion of the post-pressing drying, the extended nip press may be arranged so that the paper web is not backed by the pressing/drying felt, thus allowing free venting from the web to occur. In some cases, this zone will be augmented by a vacuum assist unit to draw steam away. This high temperature press is capable of outgoing dryness in the range of sixty-five percent versus fifty percent for conventional technology. This combination of high temperature pressing and drying can be expected to improve the maximum strength of the web by approximately 20 percent or more over conventional pressing methods. Two high temperature press dryers of this invention may be combined to achieve outgoing dryness of approximately seventy percent.

6 Claims, 4 Drawing Sheets

HEAVY-WEIGHT HIGH-TEMPERATURE PRESSING APPARATUS

FIELD OF THE INVENTION

This invention relates to papermaking machines in general. More particularly, this invention relates to paper web presses and dryers. Still more particularly, this invention relates to paper web dryers which employ an extended nip press.

BACKGROUND OF THE INVENTION

Over the years, many advances have been made in the process of converting wood pulp into paper. The papermaking art includes depositing a layer of fibrous pulp, or stock, onto a moving screen and draining excessive water from the fibrous stock to form a relatively thin, fibrous web on the surface of the screen. In order to dry the web as well as increase its strength, the web is removed from the screen and passed through various pressing rolls to reduce the amount of water remaining in the web. After passage through the press section of a papermaking machine, where the web's density has been increased, the web is conducted around multiple heated drums, or dryers, such that excess water remaining in the web is removed.

In a modern papermaking machines, it is not uncommon to have in the drying section eighty or more dryer drums, with each drum having a diameter of five feet and a length of up to 33 feet. Of necessity, these dryer drums take up an enormous floor area which greatly exceeds the floor area required for the installation of the forming and pressing section combined. Additionally, with escalating fuel costs, it is evident that if more water can be removed in the press section, less energy will be required in the drying section. Consequently, much research has been carried out in an attempt to remove ever greater quantities of water from the paper web before it leaves the press section. This reduces the number of dryer drums required and the amount of energy and steam required to drive off any remaining moisture within the web.

A breakthrough in press section design was commercialized in 1980 by the introduction of the so-called "extended nip press" (herein referred to as an ENP), which successfully increases the percent fiber in the web after pressing from 35 present to approximately fifty percent. The main features of the ENP, as compared to the prior conventional pressing technique, may be outlined as follows.

In conventional pressing, the web passes through the nip defined by counter-rotating rolls, whereas in the ENP, one of the rolls is replaced by a concave shoe. The concave surface of the shoe cooperates with the outer surface of a press roll to define therebetween an elongated or extended pressing section, such that the web is pressed with a moderate pressure for an extended period of time between the press roll and the shoe. In order to permit the web to pass through the extended nip, a moveable blanket is disposed between the concave surface and the web, so that the web is pressed between the blanket and the pressing roll during passage through the press section.

More recent improvements in the ENP have involved solving a problem of oil leakage from the nip blanket by extending the blanket beyond the ends of the backing roll where the ends may be made to take a circular shape and sealing them to rotating heads.

Further improvements in the function of the ENP have been achieved by induction heating the surface of the backing, or press roll, in the temperature range of 200 to 600 degrees Fahrenheit. The addition of heat to the ENP to form a so-called impulse dryer has resulted not only in better drying of the web, but also increased mechanical properties, such as web strength. Increased web strength can have tremendous pay-back in reducing the cost of paper production.

The ability to manufacture increased strength paper or paperboard can allow changes in the furnish, the fibers used to construct the paper. The ability to develop greater strength in a paper or paperboard web allows the use of lower-cost, and lower-strength fibers, or the use of a lower-weight paper for a particular application. Using less fiber, or fiber of lower cost, can yield a dramatic cost savings, particularly for heavy-weight paper or paperboard materials.

What is needed is a combination press dryer which can provide improved drying and strength development, particularly for heavier weight paper webs.

SUMMARY OF THE INVENTION

The dryer of the present invention achieves more effective drying by engaging the web against the dryer backing roll both before it enters the extended nip and after it leaves the extended nip. The web is thus preheated on the surface of the backing roll before it passes through the extended nip. Further, the web is retained on the surface of the backing roll to achieve post-pressing drying. During a portion of the post-pressing drying, the apparatus of this invention may be arranged so that the paper web is not backed by the pressing/drying felt, thus allowing free venting from the web to occur. In some cases, this zone will be augmented by a vacuum assist unit to draw the steam away.

In a conventional ENP, if a 42 pound sheet enters at twenty to thirty percent dryness, just one pass will generally increase dryness some ten to twenty points. With a combination of preheating, hot-pressing, and post-drying through a high temperature pressing unit, outgoing dryness can be bettered by ten to fifteen more percentage points. Thus, this high temperature pressing can be capable of outgoing dryness in the range of sixty-five percent versus current, conventional technology which is capable of outgoing dryness in the range of fifty percent. This combination of high temperature pressing and drying can be expected to improve the maximum strength of the web by approximately 20 percent or more over conventional pressing methods.

Two high temperature press dryers of this invention may be combined to achieve outgoing dryness in excess of seventy percent. The dryers may both rotate in the same direction, so that the web presents a single surface to both dryers, and the open draw between the dryers being parallel to a plane containing the axes of rotations of both dryer rolls. The open draw of the web between the dryer drums may be enclosed in vacuum assists for the removal of steam. This further increases drying of the web as it transits from one drum to the other. Alternatively, the drums may rotate in opposite directions, with the paper web presenting a different side to each drum, with the open draw crossing the plane containing the axes of rotation of the two drums.

The dryer press of this invention consists of a backing roll, the surface of which is heated by an induction heater. A backing felt transports a formed web containing twenty to thirty percent dry weight fibers. The backing felt is wrapped together with the web around approximately ninety to one-hundred degrees of the circumferential surface of the roll. After which, the backing felt is led away from the roll and the web alone continues to be wrapped for approximately another forty-five degrees around the roll until it is removed by a second drying felt. Approximately half way along its travels on the surface of the backing roll, the first felt in the web is passed through an ENP. The combination of the first felt being wrapped around a portion of the circumference of the backing roll and being more or less centered about the portion of the backing roll forming the ENP, is to create a preheat zone which warms the web before it enters the ENP, and a post-heat zone which transits into a drying zone where the web is allowed free venting before being removed from the backing roll.

It is an object of the present invention to provide an apparatus for reducing the length of a dryer section in a papermaking machine.

It is another object of the present invention to provide an apparatus for increasing the strength of a paper or a paperboard web.

It is a further object of the present invention to provide a papermaking apparatus which requires less stock or stock of a lower cost to manufacture a particular strength or grade of paper or paperboard.

It is yet another object of the present invention to provide a papermaking apparatus which can improve the surface finish on a paper web.

It is a still further object of the present invention to provide a combination press dryer which in one press can increase the dryness of a paper web by fifteen to thirty-five percentage points.

Further objects, features, and advantages of the invention will be apparent from the following detailed description when taken in conjunction with the accompanying drawings.

DESCRIPTION OF THE PREFERRED EMBODIMENTS

Figure 1:
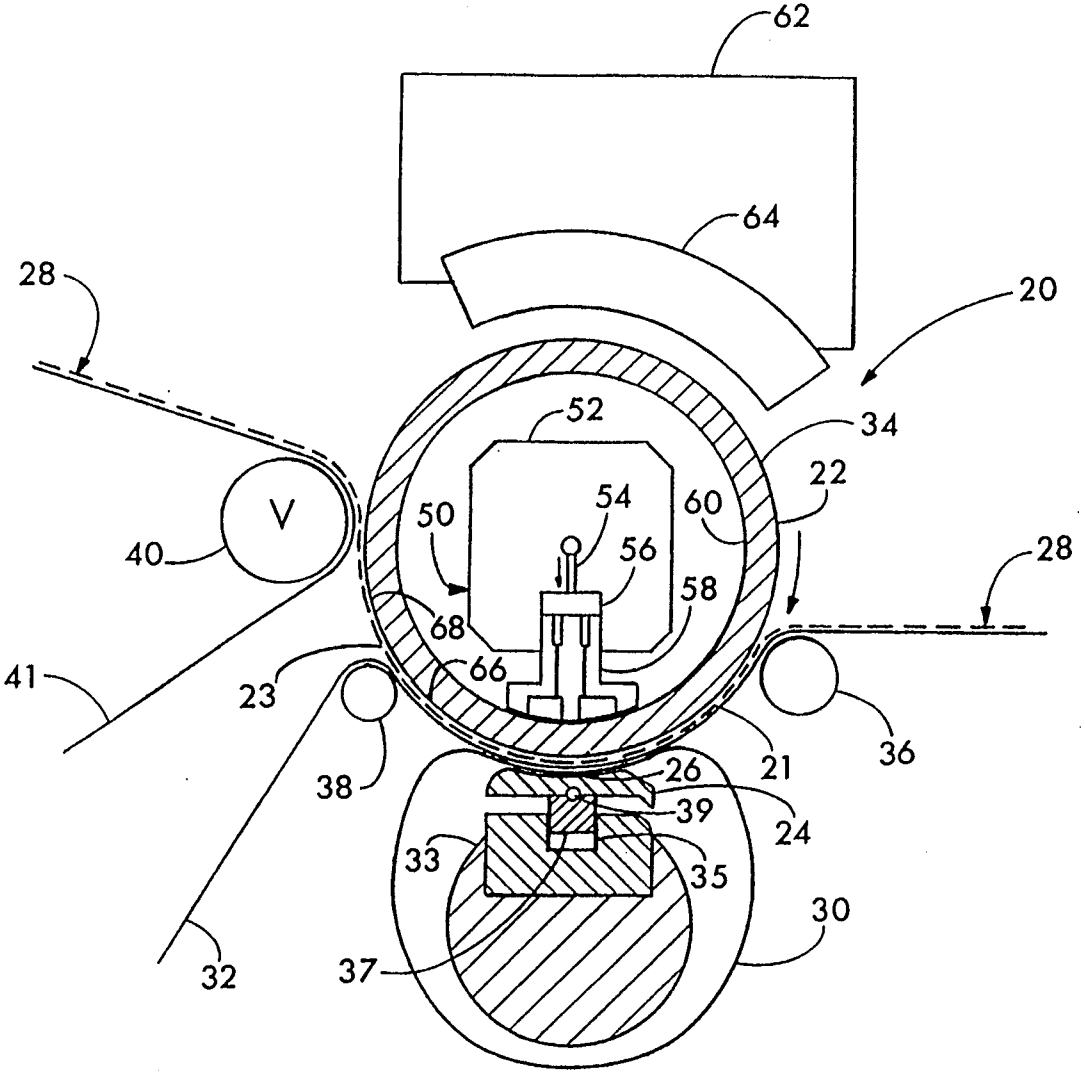
FIG. 1 is a somewhat schematic, side-elevational view of a single drum press dryer of this invention.

Referring more particularly to FIGS. 1–4, wherein like numbers refer to similar parts, an improved type of impulse dryer 20 is shown in FIG. 1. The impulse dryer 20 employs a preheat zone 21, a pressing zone or extended nip 26, and a post-heat zone 23. The zones 21, 26, 23 are defined on a press roll 22 which forms the nip 26 with a shoe 24. The shoe 24 is provided with a concave surface which faces the roll 22 and is mounted so that it is urged towards the roll 22. The press nip 26 is formed between the roll 22 and the shoe 24. A web of paper 28 is brought into contact with the surface 34 of the roll 22 by an infeed roll 36 where it is preheated by the hot surface 34 of the roll 22. The web 28 then passes through the nip 26 and is subjected to the pressing zone 26. A press felt 32 underlies the web 28 and moves beneath the web 28 and over a looped belt 30. The web 28, the felt 32 and the belt 30 together pass through the nip 26 between the shoe 24 and the roll 22.

Oil is supplied between the shoe 24 and the belt 30. The oil causes a hydrodynamic wedge of fluid to build up between the belt 30 and the shoe 24. The fluid wedge transmits pressure to the web while at the same time lubricating the movement of the web 28 through the nip 26. The press felt 32 passes through the nip 26 while underlying the paper web 28 and riding on the belt 30. The paper web 28, the press felt 32, and the belt 30, as well as the roll 22, are in engagement and so driven at the same speed. Thus the paper web 28 does not experience significant sheer force because there is no relative motion in the plane of the web 28 and the press felt 32 and the surface 34 of the press roll 22. Thus the paper web 28 is subject to principally compressive forces as it moves through the extended nip 26. The effect of this compressive force is to bring the web into intimate contact with the surface 34 of the press roll 22.

The intimate engagement of the web 28 with the press roll surface 34 under pressure facilitates the rapid heat exchange between the surface 34 of the roll 22 and the web 28. The rapid heat transfer between the roll 22 and the web 28 produces a not completely understood drying mechanism which is characteristic of the impulse dryer. The rapid heating of the paper web vaporizes some of the water contained in the web. The steam which has been produced from the water in the web is trapped between the surface 34 of the roll 22 and the paper web 28. Its only route of escape is through the paper web 28 into the press felt 32. The rapid downward movement of the steam from the upper surface of the paper web 28 downwardly into the press felt 32 has the effect of blowing water contained in the web 28 into the felt 32. This process, impulse drying, results in the rapid removal of water from the paper web 28.

After the nip or pressing zone 26 the web 28 moves through a post-heat zone. In the post-heat zone the web 28 is backed by the felt for a distance, after which the felt 32 is stripped away by a stripping roll 38 and the web 28 is free to vent from its back side. After vented post-heating, the web 28 is removed from the press roll 22 by a transfer felt 41 which is fed around out the feed roll 40.

As will be appreciated by those versed in the art of papermaking, the cross-machine width of the paper web 28 will normally be between one-hundred and four-hundred inches, with the components of the impulse dryer such as the roll 22 being in general somewhat longer, as necessitated by their particular function.

The looped belt 30 and its method of support are conventional and are described more fully in U.S. Pat. No. 4,673,461 to Roerig et al. The belt 30 is a continuous loop. It has a cross-machine width greater than the press roll 22, so that the ends of the belt (not shown) may be sealed to circular closures (not shown) which seal the ends of the belt, thus containing the nip lubricating oil within the sealed belt 30. A stationary beam 33 is contained within the belt 30. The beam adjustably supports the shoe 24 by means of a hydraulic piston chamber 35 in which is positioned a piston 37. The shoe 24 is pivotally supported on a roller pin 39, seated in a downward facing groove in the shoe 24 and an upward facing groove in the piston 37. The piston is urged upward by fluid pressure beneath the piston in the chamber 35, which is in the form of an elongated slot, slidably receiving the piston, and extending the full width of the machine beneath the shoe 24. The belt 30 may be guided by means of curved guides (not shown) or by internal air pressure which serves to stabilize the belt 30 during start-up. The guides or air pressure also stabilize the belt 30 if any fluttering or instability should occur during normal operation.

Once the belt 30 has reached operational speed, centrifugal force will cause the belt 30 to assume a naturally circular shape, except where traversing the nip 26 between the shoe 24 and the press roll 22.

The press felt 32 is supported on the infeed roll 36 and the outfeed roll 38. The infeed press felt roll 36 and outfeed roll 38 will typically have a diameter of two feet, where the corresponding diameter of the press roll 22 is five feet. The rolls 36, 38 serve to bring the press felt into position to be fed through the nip 26 of the impulse dryer 20. The press felt 32, after leaving the outfeed roller 38, is processed by a felt dryer (not shown), which removes water and excess moisture from the felt 32 before it returns for reuse over the infeed roller 36.

The press roll 22 in FIG. 1 is shown employing a hydraulic crown control mechanism 50 which has a non-rotating crown support beam 52. The crown support beam has an oil supply port 54 which supplies oil to piston cavities 56 which drive pistons 58 against the inner surface 60 of the metallic base shell 38. Pistons 58 which are spaced along the central beam or shaft 50 serve to apply a constant pressure between the press roll 22 and the shoe 24.

In FIG. 1, an induction heater 62 is shown schematically. It has coils 64 which are energized with high frequency current. The induction heater 62 is conventional in nature. It employs oscillating magnetic fields caused by the high frequency alternating current, which create eddy currents in the surface 34 of the roll 22. The currents induced produce resistance heating in the surface 34 thereby heating it to the desired temperature. The temperature of the roll surface is preferably raised to between 400 degrees and 500 degrees Fahrenheit.

High temperature pressing studies conducted with heavy-weight linerboard grades indicate that web preheating in the preheat zone 21, hot pressing in the nip 26, and post drying in the post-heat zone 23, if conducted while the web 28 is restrained on the surface 34 of the drum 22, offer higher water removal capabilities and improved product strength over conventional pressed, then dried, sheets.

It is important that the web 28 be restrained without sticking to the surface 24 in order to avoid the delamination that will occur when sticking occurs. It is equally important that the web 28 be restrained against the surface 34 during the pressing and drying process in order to maximize water removal and strength development.

The impulse dryer 20 presses and dries the paper web 28 in three zones, a preheat zone 21, a hot-pressing zone (or extended nip) 26, and a post-heat zone 23, as shown in FIG. 1. The post-heat zone 23 is divided into a web-backed zone 66 and a free-venting zone 68.

The web 28 is carried to the heated cylinder 22 by a hot press felt 32. The cylinder 22 is typically heated to a temperature of 400 degrees Fahrenheit; however, temperatures in the range of 300 degrees to 900 degrees Fahrenheit are well within the realm of this process, provided that other technological barriers can be overcome. A 300 degrees to 500 degrees Fahrenheit system is currently feasible. The function of the three zones, 21, 26, 23 are described as follows:

In the preheat zone 21, the web 28 is held in contact with the roll surface 34 so that its temperature may be raised to 212 degrees Fahrenheit or higher.

In the nip, or hot press zone, 26, the web 28 is subjected to high pressure to facilitate water removal by venting flashing stream into the hot felt. This zone 26 will develop the most strength.

In the post-heat drying zone 23, the web 28 is constrained against the hot surface 34 of the roll 22. An important function of the drying zone 23 is the free drying zone 68 which allows free venting from the web 28 to occur while the web is constrained on the surface 34. The free venting zone 68 could be augmented by a vacuum assist unit (not shown) to draw the steam away from the web 28.

In a conventional extended nip press, if a 42-pound sheet enters at twenty to thirty percent dryness, just one pass through the press will generally increase dryness some ten to twenty percentage points. Percent dryness is the percent of the web 28 which constitutes dry fiber by weight. With the combination of preheating, hot pressing, and post drying through a high temperature pressing unit 20, the outgoing dryness can be bettered by five to fifteen percentage points over a conventional dryer. Thus, this high temperature pressing with pre- and post-heating can be capable of outgoing drynesses in the range of sixty-five percent versus current conventional technology in the fifty percent range.

Pressing along with drying improves product strength versus drying only. The high temperature pressing unit described should maximize strength development some twenty percent or more over conventional pressing, depending on the product furnish (fiber content) and bonding characteristics. Strength development may be best achieved by multiple hot pressing steps during the post drying cycle.

Figure 2:
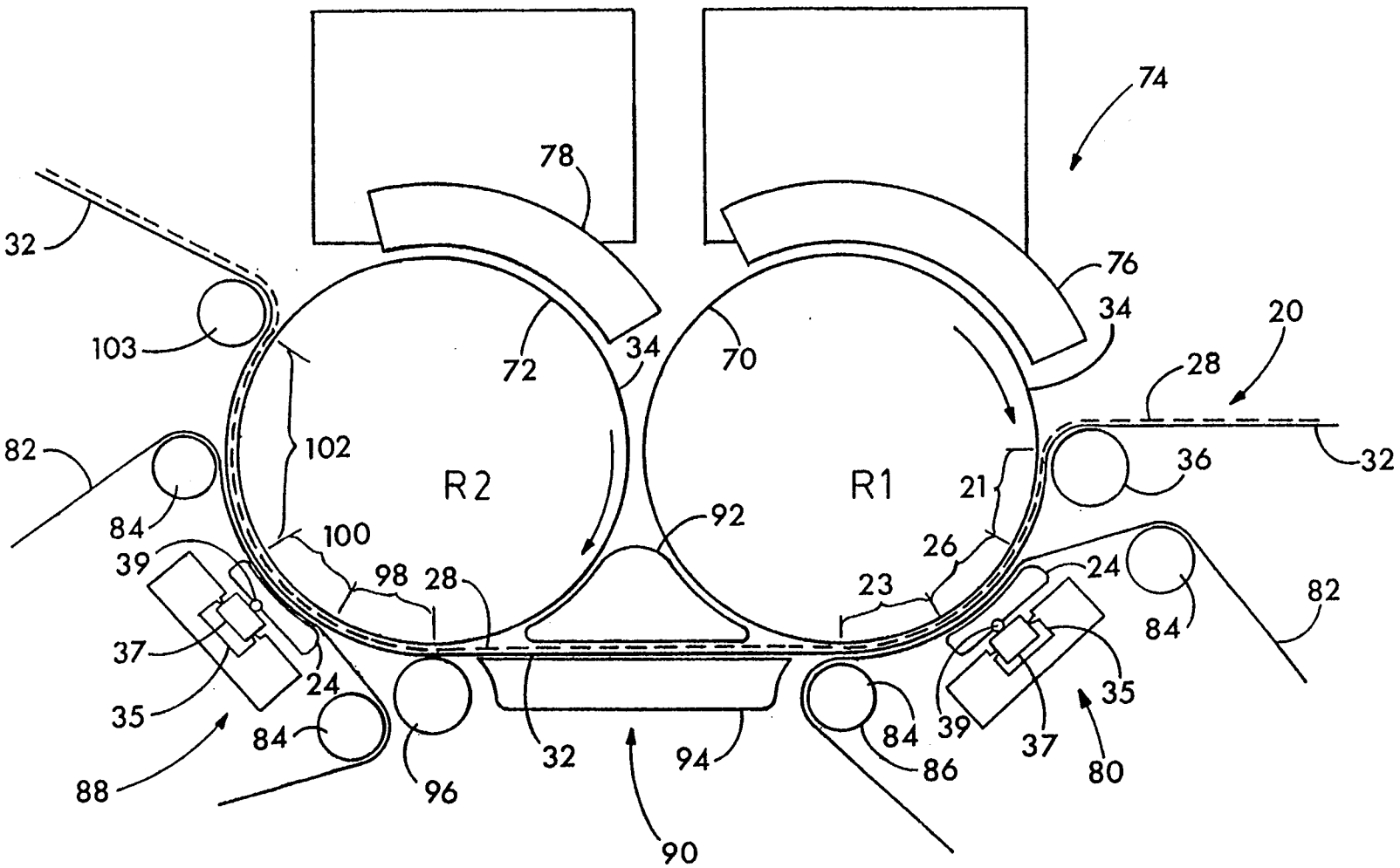
FIG. 2 is a somewhat schematic, side-elevational view of two press dryers of this invention, wherein both dryer rolls rotate in the same direction.

To achieve even greater solid content in a web, two press rolls 70, 72 may be combined in a dryer 74, as shown in FIG. 2. Backing rolls 70, 72 are heated by induction heaters 76, 78. The backing roll 70 is employed with an extended nip press 80 which is shown in FIG. 2 as an open-ended type where the blanket 82 is supported by blanket rolls 84 and wherein one blanket roll 86 also functions as a press felt 32 outfeed roller. Similarly, the backing roll 72 has an extended nip press 88.

As will be understood by those skilled in the art of papermaking, the extended nip presses 80, 88 could be of the apple type shown in FIG. 1. Although the particular type of extended nip is a design choice, in many circumstances the apple-type extended nip is preferable because the end seals contain the lubricating oil which reduces friction between the shoe 24 and the looped belt 82.

The extended nip 80 on the first roll 70 is arranged with an infeed roller 36 which brings the heated press felt 32 together with the web 28 into contact with the surface of the roll 70. Thus, in a way similar to the impulse dryer 20, preheat zones 21, pressing zones 26, and post-heat zones 23 are defined. The web 28 backed by the felt 32 then enters a draw between the rolls 70, 72. The web 28 and the felt 32 pass in the draw 90 between an upper vacuum assist 92 and a lower vacuum assist 94, which vent and remove steam from the felt 32 and the web 28, thus drying the web 28.

After passing through the draw 90, the web 28, and the felt 32, are brought into contact with the surface 34 of the roll 72 by an infeed roller 96. The web 28 then progresses through the second preheat zone 98 into a second pressing zone 100, which is followed by a second post-heat zone 102. Thus the dryer 74 increases web dryness and strength by adding a vacuum assist steam removal zone formed by the draw 90 as well as the second preheat, pressing, and post-heat zones 98, 100, 102. The second roll 72 may be at a higher temperature than the first roll 70.

Too much drying of the web 28 on a single roll can lead to adhesion of the web 28 to the roll surface 34. This leads to delamination in the web 28 as it is removed from the roll. The dryer 74 advantageously allows increased drying while preventing adhesion of the web 28 to the roll surfaces 34. The second post-heat zone 102 could include a free venting zone similar to the zone 68 shown on FIG. 1. However, by the time the web 28 reaches the second post-heat zone 102, the web 28 should be sufficiently dry, so that venting into the felt will not impede the drying process.

With webs of certain fiber composition (furnishes), especially those which are multi-ply in composition, the web strength may be optimized by pressing and drying both sides of the web. An impulse dryer 104 shown in FIG. 3 employs a first press roll 70 and a second press roll 72 which rotate in opposite directions. The first roll 70 is heated by a first induction heater 76. A second roll 72 is heated by a second induction heater 78. A web 28 on a press felt 32 is wrapped onto the first roll 70 by an infeed roller 36 where it passes through a preheat zone 21, a pressing zone 26 formed by the extended nip press 80, and a post-heat zone 23. Upon leaving the post-heat zone 23, the press felt 32 is stripped away by a stripping roller 38, leaving the unbacked web to enter an open draw 106 formed between the two rolls, 70, 72. Between where the felt 32 is stripped from the first roll 70 and where the web 28 enters the open draw 106, a first side 108 of the web 28 enters a free venting region 110. Then the web enters the open draw 106, where both sides of the web are vented. Next, the web enters a free venting zone 112 where the second side 114 of the web 28 may dry by freely venting.

A second press felt 116 is brought into contact with the web 28 on the surface 34 of the roll 72 by a second infeed roller 118. After the second infeed roll 118, the web 28 enters the second preheat zone 98. From the second preheat zone 98, the web travels to the second pressing zone 100 formed by the second extended nip press 88, finally exiting through the second post-heat zone 102.

Figure 3:
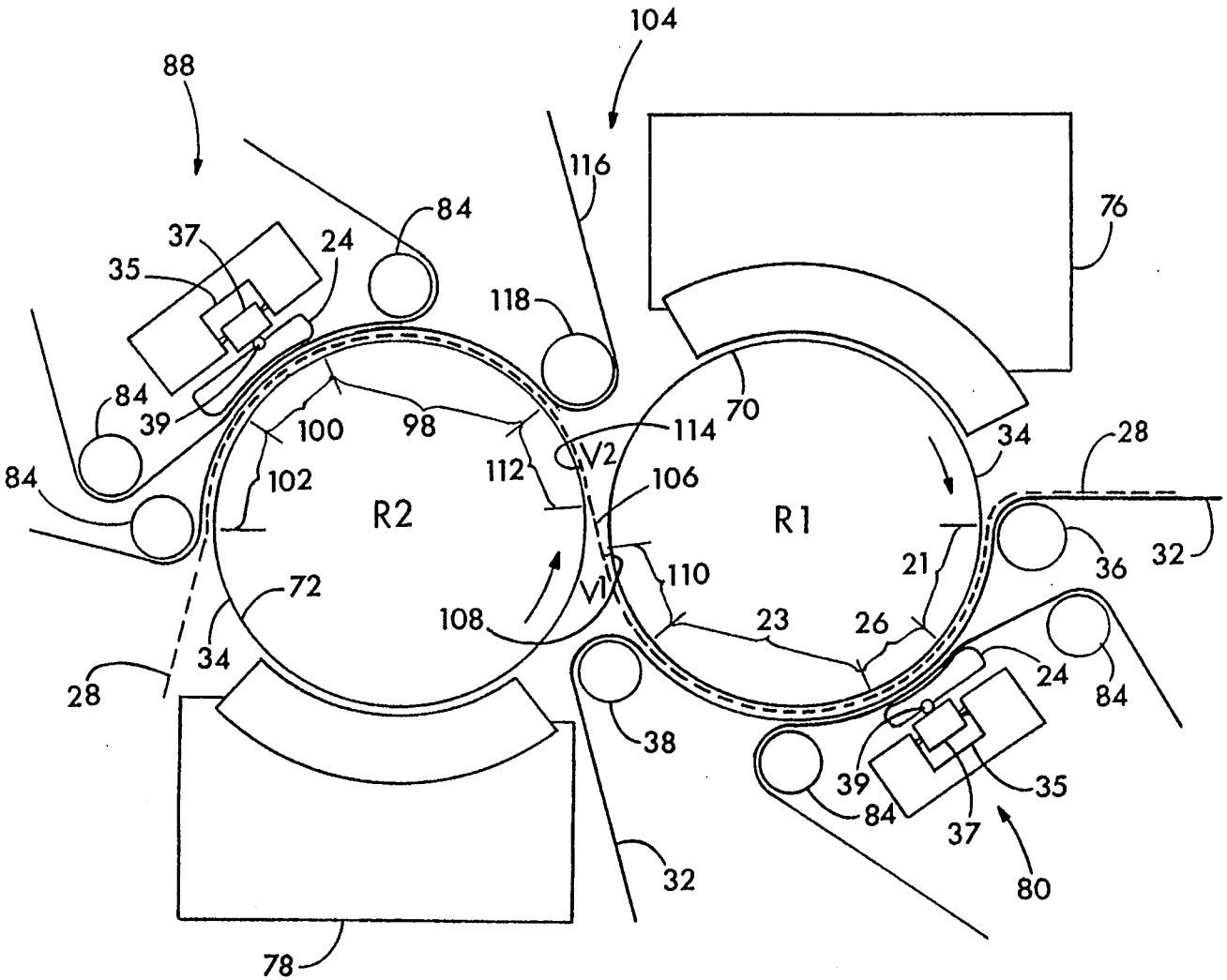
FIG. 3 is a somewhat schematic, side-elevational view of two press dryers of this invention wherein the dryer drums rotate in opposite directions.

The impulse dryer 104 shown in FIG. 3 is capable of longer post-drying zones 23, 102. It has a stream venting zone comprised of the free-venting zones 110, 112, and the open draw 106, where both sides of the web 28 are vented. It may also be possible to optimize web surface properties during the second and final pressing step before exiting from the dryer 104. Once the solid content of the web approaches 70 plus percent solids, heated pressing offers potential surfacing finishing means. Since this unit may dewater the web to dryness in the seventy plus percent range, surface finish could be initiated in the second nip 100. The surface finish could proceed further by the addition of a third heated nip and/or a hot calender. The shoe 24 of the dryer 104 is shown in FIG. 3 in position to have an increased pressure profile at the inlet to the extended nip press with pressure tapering off toward the exit. The high rise in pressure at entrance may provide improved surface finishing. However, the shoe may alternatively be set to have a high peak pressure at the extended nip exit. Which configuration is desirable will depend upon entering solids. For example, if entering solids is near 75 percent, the peak should be near the nip entrance. If entering solids is 65 percent, the peak should be near the exit. This takes into account finishing or precalendering the sheet when it has just about the right amount of water content to be of benefit to the web—35 percent to 15 percent.

Figure 4:
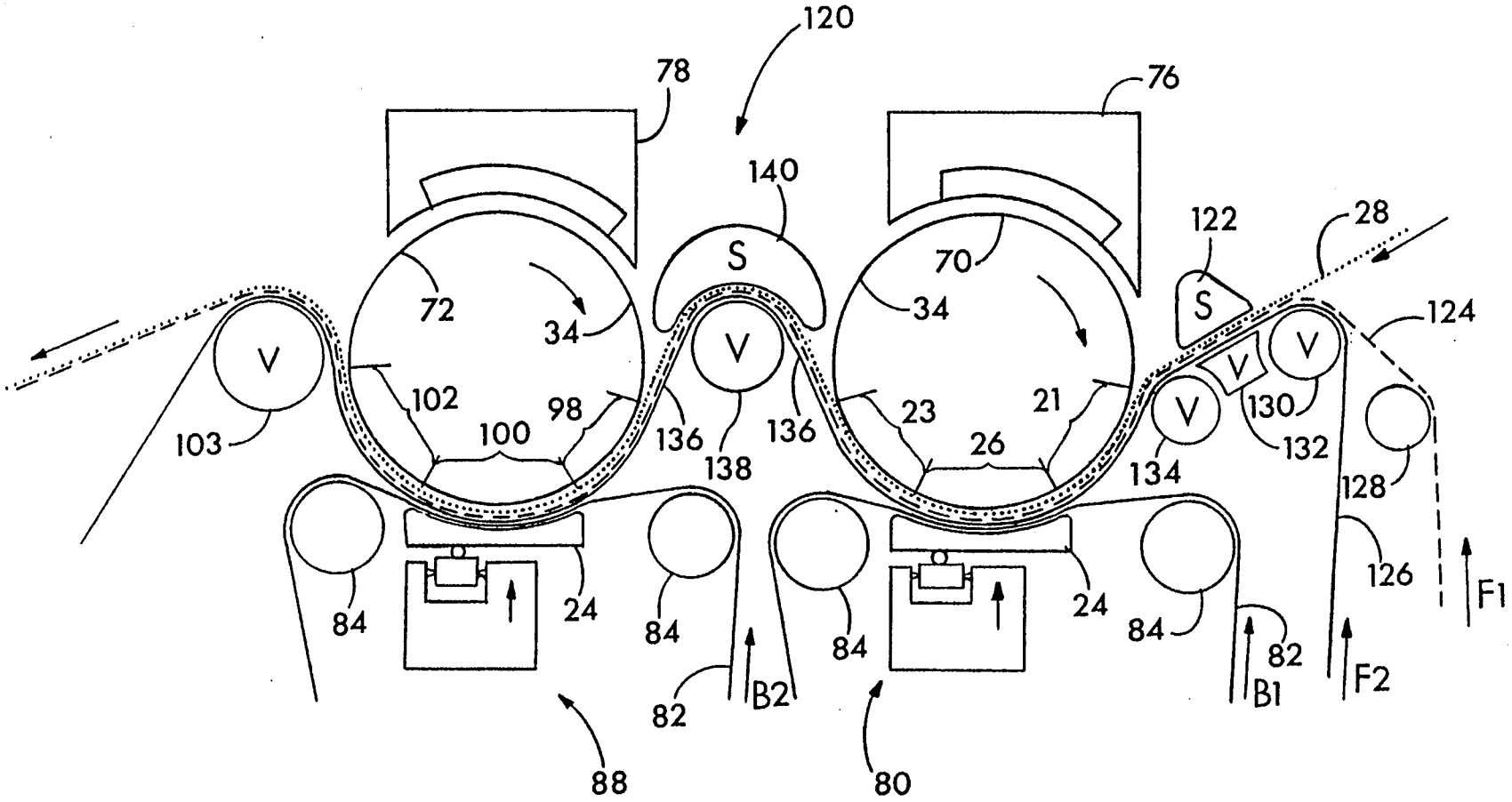
FIG. 4 is a somewhat schematic, side-elevational view of an alternative embodiment of this invention having two press dryers.

An alternative impulse dryer 120 is shown in FIG. 4 which employs a steam shower 122 to preheat the web 28 before pressing and drying. The dryer 120 has two rolls 70, 72 which are arranged in tandem and rotate in the same direction, similar to the dryer 74, shown in FIG. 2. The dryer 120 employs a double felt employing an upper felt 124 and a lower felt 126. The upper felt 124 must be very open and made from heat resistant fibers.

A felt meeting these conditions is available from Albany International by the designation "R40" or "Albany Felt R." The upper felt 124 should be hydrophobic to resist water and thus resist rewetting the web 28. A lower felt 126 underlies the upper felt and receives moisture from the web 28. To facilitate the reception of steam and water from the web 28 through the upper felt 124, the lower felt will preferably be hydrophilic, an exemplary felt being the type available from Albany International under the designation "BXC5" or "Albany Felt B."

The upper felt 124 is brought over an infeed felt roll 128 and overlies and joins the lower felt 126 over a first vacuum roll 130 where it also joins the web 28. The web 28 overlying the upper felt 124 and the lower felt 126 then enters a steam shower 122 while being restrained by a vacuum box 132. The steam shower 122 heats the web to approximately 212 degrees Fahrenheit, the boiling point of water. After this, the web and the upper felt 124 and lower felt 126 are wrapped by a second vacuum roller 134 onto the roll surface 34 of the roll 70.

Once wrapped onto the roll 70, the web is preheated in the preheat zone 21, passes through the pressing zone or nip 26 formed by the extended nip 80, and then continues on to the post-heat zone 23. From the post-heat zone 23, the web 28 and the backing felts 124, 126 enter the draw 136 between the first roll 70 and the second roll 72. A mid-draw vacuum roll 138 serves to constrain the web 28 against the felts 124, 126. The vacuum roll 138 also increases the wrap of the web 28 around the first roll 70 and the second roll 72. The increased wrap increases the post-heat zone 23 and the preheat zone 98.

A second steam shower 140 prevents the web from cooling in the draw 136. The second steam shower 140 may be omitted if significant cooling is not found to take place in the draw 136. It is, however, important that the web remain restrained and heated as it traverses the dryer 120 in order to maximize the strength developed in the web 28. The blankets 82 of the extended nips 80, 88 will preferably be of the vented type to maximize the amount of water removed from the web as it transits the pressing zone 26 of the first extended nip 80 and the pressing zone 100 formed by the second extended nip press 88. The felt 124 is turned away from the web 28 and the felt 126 at final outfeed vacuum roll 103.

Best properties in the web 28 are developed while the sheet is hot, pressed, and restrained during the heating and pressing process. This restrained pressing system must have adequate venting of the water and steam to inhibit sheet damage by delamination. This restrained hot pressing system should achieve solids and property development without causing sheet delamination.

It is also important to utilize hot release roll surfaces (non-sticking) and a hot release felt surface on the upper felt 124 to assure that the sheet will separate from the last heated roll 72 and the felt 124, and not delaminate at the exit from the press 120. The press 120 will preferably utilize ten to twenty inch extended nip press shoes 24, and forty-eight to sixty inch diameter press rolls 70, 72. This should allow operation in the 1,500 to 3,000 feet per minute range for forty-two pound linerboard and achieve outgoing solids in the range of sixty to seventy percent, with the press operating at temperatures from 400 degrees to 500 degrees Fahrenheit.

Sheet presteaming is utilized at the entrance of the press, but may be optional or not necessary between the two heated rolls 70, 72. Vacuum as applied by vacuum rolls 130, 134 and vacuum box 132 is necessary to assure proper presteaming in web restraint. Although the objective is to operate the press 120 at temperatures of 500 degrees or less, the press is not restricted in temperature. Higher temperatures may be desirable in some circumstances.

It should be understood that wherein two rolls are shown employed with presteaming of a paper web, a single roll press of this invention could be employed with a steam shower preheat.

It should be understood that where open, extended nip presses employing rolls are shown, closed ended, apple-type extended nip presses could be used. Furthermore, where an apple-type extended nip press is shown, an open-ended roll type press could be used.

It should also be understood that where one or two press rolls with induction heaters and extended nip presses are shown, three or more rolls in tandem or counter-rotating could be employed.

It should also be understood that although the temperature of a particular backing roll is suggested to be 400 to 500 degrees Fahrenheit, other individual roll temperatures or combination of roll temperatures could be used to develop specific properties in a particular paper web of a given furnish.

It should also be understood that where a first felt which is open and hydrophobic is shown in use with a second felt which is hydrophilic, the properties of the two felts could be combined in a single felt. Furthermore, where a single felt is shown, two or more felts could be used.

It should also be understood that where induction heaters are shown and described, other types of heaters including but not limited to infrared heaters, direct flame impingement heaters, hot gas heaters, or steam heaters could be employed.

It should further be understood that wherein the impulse dryers 20, 74, 104 and 120 are described as particularly advantageous for the processing of linerboard, paper webs of varying weight and furnish could be advantageously processed by the disclosed apparatus.

It should be understood that the invention is not confined to the particular construction and arrangement of parts herein illustrated and described, but embraces such modified forms thereof as come within the scope of the following claims.

I claim:

1. An apparatus for pressing and drying a formed web, comprising:

a first dryer roll mounted for rotation and having a cylindrical surface;

a felt which underlies the web;

a shoe and a belt which engages the felt and the web against the first dryer roll cylindrical surface, forming an extended nip press;

a heater which heats portions of the first dryer roll surface;

a second roll upstream of the first dryer roll, wherein the felt and the web pass over the second roll and are engaged against the first dryer roll surface at a position ahead of the extended nip press, thereby defining a preheating region between the second roll and the extended nip press;

a third roll downstream of the first dryer roll, wherein the felt and the web pass over the third roll and are engaged by the third roll against the first dryer roll surface at a position downstream of the nip press to define a post heat zone;

a steam shower positioned ahead of the second roll to discharge heated water steam onto the web in advance of the first dryer roll;

a second dryer roll having a cylindrical surface, located downstream of the first dryer roll, wherein the felt and the web pass over the third roll and thence to the second dryer roll;

a second heater which heats the second dryer roll cylindrical surface;

a second shoe and belt which engages the felt and the web against the second dryer roll cylindrical surface, forming a second extended nip press through which the web passes subsequent to engagement with the first dryer roll; and an outfeed roll downstream of the second shoe and belt, over which the felt and the web pass.

2. The apparatus of claim 1 wherein the felt is comprised of:

an upper felt formed of an open felt; and a lower felt which backs the upper felt, wherein the lower felt is hydrophilic.

3. The apparatus of claim 1 further comprising a second steam shower positioned to discharge heated water steam onto the web as it travels over the third roll.

4. The apparatus of claim 1 wherein the second roll is a vacuum roll.

5. The apparatus of claim 1 wherein the third roll is a vacuum roll.

6. The apparatus of claim 1 wherein the heater is an induction heater.

* * * * *